US009074319B2

(12) United States Patent
Good et al.

(10) Patent No.: US 9,074,319 B2
(45) Date of Patent: Jul. 7, 2015

(54) MONOFILAMENT YARN FOR A PAPER MACHINE CLOTHING FABRIC

(71) Applicant: Voith Patent GmbH, Heidenheim (DE)

(72) Inventors: Brian Good, Summerville, SC (US); Vikram Dhende, Summerville, SC (US)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/937,845

(22) Filed: Jul. 9, 2013

(65) Prior Publication Data

US 2014/0262099 A1 Sep. 18, 2014

Related U.S. Application Data

(63) Continuation-in-part of application No. 13/835,737, filed on Mar. 15, 2013.

(51) Int. Cl.

| | |
|---|---|
| ***D21F 1/10*** | (2006.01) |
| ***D01F 6/62*** | (2006.01) |
| ***D02G 3/02*** | (2006.01) |
| ***D02G 3/44*** | (2006.01) |
| ***D21F 1/00*** | (2006.01) |
| ***D01D 10/02*** | (2006.01) |

(52) U.S. Cl.

CPC ..... *D21F 1/0027* (2013.01); *Y10T 428/298* (2015.01); *D01D 10/02* (2013.01); *D01F 6/62* (2013.01)

(58) Field of Classification Search

CPC ..... D21F 1/00; D21F 1/0027; D21F 7/08; D01F 1/00; D01F 1/10; D01F 6/62; D01D 10/02; D01D 5/098; D10B 2331/04; Y10T 428/298

USPC ..... 162/348, 358.1–358.3, 900–904; 428/221, 364, 370, 374, 395, 401; 442/181, 189, 195, 199; 139/383 A, 139/383 B, 383 R

See application file for complete search history.

(56) References Cited

U.S. PATENT DOCUMENTS

| | | | | | |
|---|---|---|---|---|---|
| 4,060,516 | A | * | 11/1977 | Kuratsuji et al. | 528/308 |
| 4,998,569 | A | * | 3/1991 | Tate | 139/383 A |
| 5,460,869 | A | | 10/1995 | McKeon | |
| 5,605,743 | A | * | 2/1997 | Reither | 442/414 |
| 5,700,881 | A | * | 12/1997 | Wagner et al. | 525/440.05 |
| 5,888,915 | A | * | 3/1999 | Denton et al. | 442/200 |
| 6,319,606 | B1 | * | 11/2001 | Best | 428/395 |
| 7,435,474 | B2 | * | 10/2008 | Zhang et al. | 428/296.7 |
| 7,645,508 | B2 | * | 1/2010 | Uemura | 428/370 |
| 7,935,225 | B2 | * | 5/2011 | O'Brien et al. | 162/289 |

(Continued)

FOREIGN PATENT DOCUMENTS

EP 0 158 710 A1 10/1985

OTHER PUBLICATIONS

Wu et al., "Fire retardancy of a buckypaper membrane," 2008, Carbon, ol 46 pp. 1164-1165.*

(Continued)

*Primary Examiner* — Jose Fortuna
(74) *Attorney, Agent, or Firm* — Taylor IP, P.C.

(57) ABSTRACT

A paper machine clothing (PMC) fabric includes a plurality of monofilament yarns, at least some of the monofilament yarns having a composition formed of polyethylene terephthalate (PET). The PET monofilament yarns have an abrasion resistance of greater than 6,000 cycles.

15 Claims, 3 Drawing Sheets

(56) References Cited

U.S. PATENT DOCUMENTS

| | | | | |
|---|---|---|---|---|
| 2006/0009582 | A1* | 1/2006 | Zhang et al. | 525/178 |
| 2009/0075543 | A1* | 3/2009 | Zhang et al. | 442/199 |
| 2009/0208682 | A1* | 8/2009 | Alfaro et al. | 428/34.9 |
| 2011/0159762 | A1 | 6/2011 | Sen et al. | |
| 2012/0214374 | A1 | 8/2012 | Mahesha et al. | |
| 2012/0321832 | A1 | 12/2012 | Makepeace | |
| 2013/0007999 | A1* | 1/2013 | Sen et al. | 28/141 |
| 2013/0008621 | A1* | 1/2013 | Sen et al. | 162/289 |
| 2013/0008622 | A1* | 1/2013 | Abraham et al. | 162/358.2 |
| 2013/0011652 | A1* | 1/2013 | Abraham et al. | 428/221 |
| 2014/0124973 | A1* | 5/2014 | Alfaro et al. | 264/173.16 |
| 2014/0262098 | A1* | 9/2014 | Good et al. | 162/289 |
| 2014/0272371 | A1* | 9/2014 | Good et al. | 428/221 |

OTHER PUBLICATIONS

T. Kashiwagi, "Flame Retardant Mechanism of the Nanotubes-based Nanocomposites Final Report," Sep. 2007, US Department of Commerce, pp. 1-65.*

Teflon® PTFE, fluoropolymer resin Properties Handbook, Jul. 1996, DUPONT, pp. 1-35.*

* cited by examiner

MONOFILAMENT YARN FOR A PAPER MACHINE CLOTHING FABRIC

CROSS REFERENCE TO RELATED APPLICATIONS

This is a continuation-in-part of U.S. patent application Ser. No. 13/835,737, entitled "MONOFILAMENT YARN FOR A PAPER MACHINE CLOTHING FABRIC", filed Mar. 15, 2013, now abandoned, which is incorporated herein by reference.

BACKGROUND OF THE INVENTION

1. Field of the Invention

The present invention relates to a paper machine clothing fabric, and more particularly, to monofilament yarns used in the paper machine clothing fabric.

2. Description of the Related Art

Polyethylene terephthalate (PET) is a polymer having good tensile properties, processability and low moisture absorption. PET is used extensively in apparel, home furnishings and industrial applications. Although PET has been utilized in the paper machine clothing (PMC) industry, due to the hostile conditions of the paper manufacturing process the mechanical life of PMC fabrics formed from PET is limited. During the operation of the papermaking machine the hostile conditions, such as mechanical stress, heat and moisture, work to break PET monofilament yarns down, thus shortening the life of a fabric formed from such yarns.

Although efforts have been made to increase the life of PMC fabrics formed from PET monofilament yarns, each proposed solution to the problem of low abrasion resistance has its disadvantages. For example, one approach to solving the problem of low abrasion resistance of PET monofilament yarns was to use high molecular weight PET, as evidenced by EP 0 158 710 A1. Other efforts have involved the utilization of various additives to improve the physical properties of PET monofilament yarns, such as abrasion resistance. Each of these proposed solutions, however, requires expensive resin, expensive additives, and/or longer processing times which lead to higher production costs.

What is needed in the art is a PMC fabric and, more particularly, a PMC fabric yarn having improved or higher abrasion resistance, which is cost effectively produced without the need for additional additives or expensive resin.

SUMMARY OF THE INVENTION

The present invention provides a paper machine clothing (PMC) fabric including a plurality of monofilament yarns, at least some of the monofilament yarns formed from polyethylene terephthalate (PET). The PET monofilament yarns according to the present invention have an abrasion resistance of between approximately 6,000 and 20,000 cycles.

The invention in another form is directed to a paper machine clothing (PMC) fabric yarn for use in a PMC fabric. The PMC fabric yarn formed from polyethylene terephthalate (PET) and has an abrasion resistance of greater than 6,000 cycles, for example greater than 10,000 cycles or greater than 15,000 cycles. The PMC fabric yarn formed from PET has an abrasion resistance of between 6,000 and 20,000 cycles.

The present invention further provides a method of manufacturing a paper machine clothing (PMC) fabric yarn for use in a PMC fabric including the steps of: melting polyethylene terephthalate (PET); spinning the PET into a filament; and drawing the filament into a monofilament PMC fabric yarn having an abrasion resistance of between 6,000 and 20,000 cycles.

An advantage of the present invention is the PET monofilament yarns exhibit excellent abrasion resistance without the use of additives or modifications to the molecular weight of the PET resin or the requirement of additional processing steps. Further, the increased abrasion resistance results in a longer life expectancy of the yarns and, thus, the fabric formed from the PET monofilament yarns.

An additional advantage of the PET monofilament processed according to the present invention is that the maximum shrink force temperature of the PET monofilament is lowered. The lower shrink force temperature will enable a lower heat set temperature for spiral and woven fabrics which should result in lower energy and production costs.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
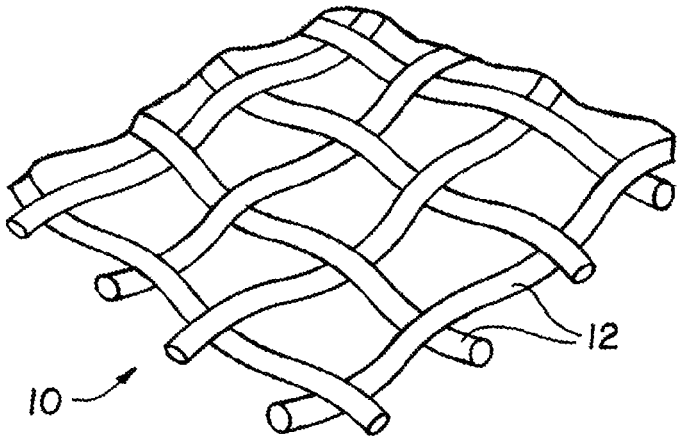
FIG. 1 is a schematic illustration of a portion of a woven PMC fabric according to the present invention.
Figure 2:
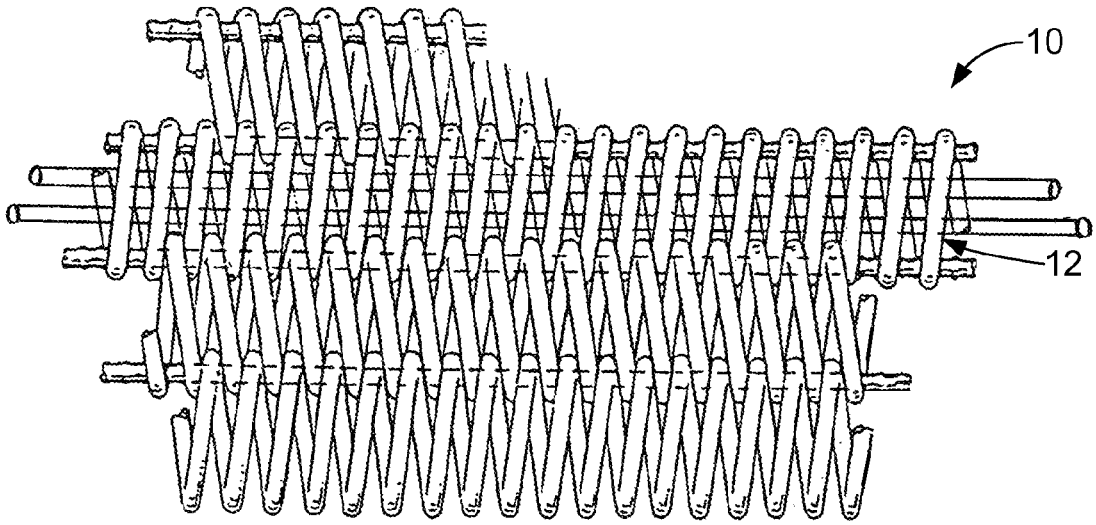
FIG. 2 is a partial schematic illustration of a spiral PMC fabric according to the present invention.

Referring now to the drawings, and more particularly to FIG. 1, there is shown a woven paper machine clothing (PMC) fabric 10 which generally includes a plurality of monofilament yarns 12. The PMC fabric 10 may also be in the form of a spiral fabric 10, which is illustrated in FIG. 2. At least some of the yarns 12 are formed from polyethylene terephthalate (PET) and have an abrasion resistance of between 6,000 and 20,000 cycles. Other physical properties of the PET monofilament yarns formed according to the present invention are similar to those of PET monofilament yarns formed according to the state of the art.

Figure 3A:
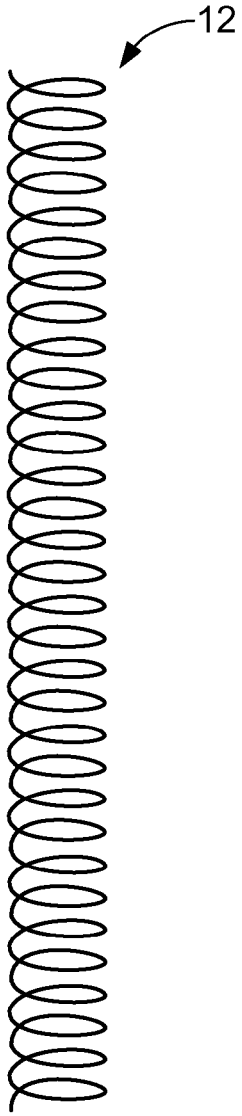
FIG. 3A is a schematic illustration of side view of a spiraled monofilament yarn which may be used with the PMC fabric shown in FIG. 2.
Figure 3B:
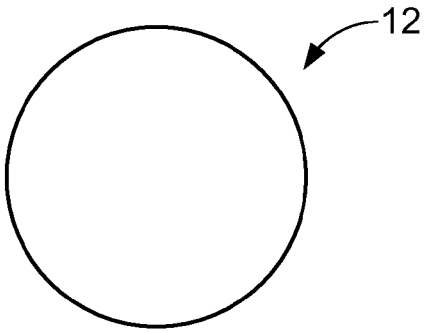
FIG. 3B is an end view of the monofilament yarn shown in FIG. 3A.

Referring now to FIGS. 3A and 3B, there is shown one of the PET monofilament yarns 12 according to the present invention. The inventive PET monofilament yarns 12 are converted into a shaped spiral yarn, as illustrated in FIG. 3A, using a thermomechanical process. Typically, this process takes place at elevated temperatures. According to the present invention, however, by lowering the process temperatures it is possible to reduce the maximum shrink force temperature of the monofilament. Referring now to FIG. 3B, there is shown an end view of PMC fabric yarn 12 which may be used with the PMC fabrics shown in FIGS. 1 and 2.

PET monofilaments 12 according to the present invention may have a diameter between approximately 0.05 and 1.00 millimeters (mm), for example 0.55 mm or 0.30 mm.

It is feasible to add an additive or multiple additives to improve, for example, the chemical stability, hydrolytic stability or heat stability of the PET monofilament yarns. For example, Stabaxol® may be added to the PET in order to improve the hydrolytic stability of PMC monofilaments formed therefrom.

Figure 4:
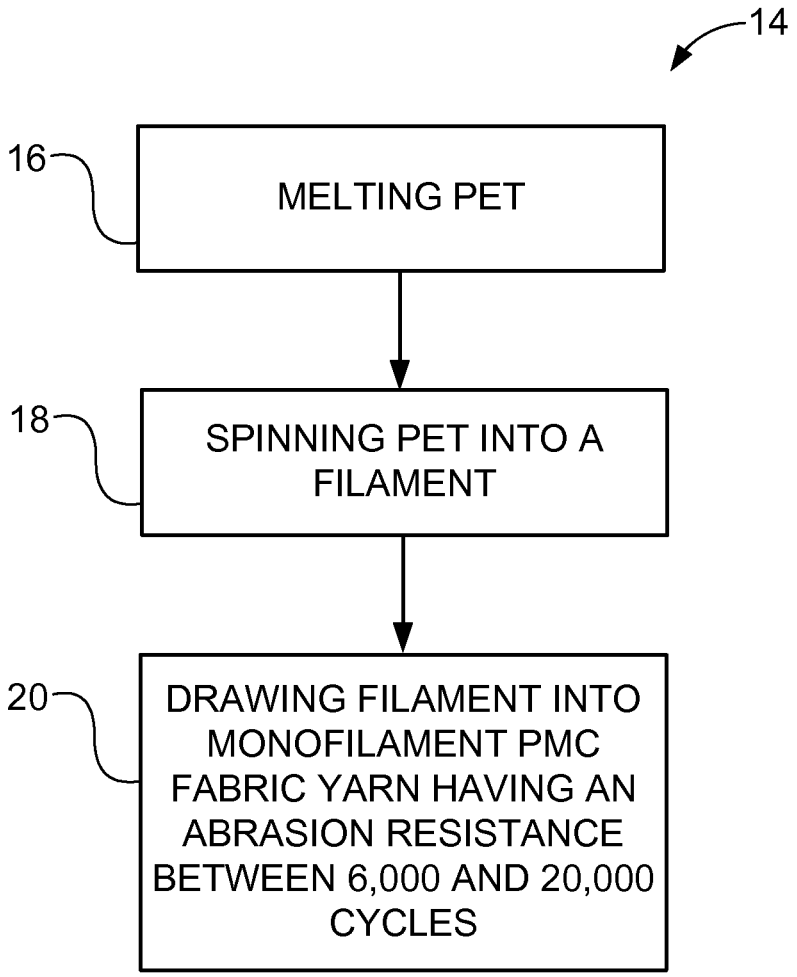
FIG. 4 is a flow chart of a method of manufacturing a PMC fabric yarn for use in a PMC fabric according to the present invention.

Referring now to FIG. 4, there is shown a flow chart of a method 14 of manufacturing PMC fabric yarn 12 according to the present invention. Method 14 according to the present invention generally includes the steps of melting the polyethylene terephthalate (PET) (block 16); spinning the PET into a filament (block 18); and drawing the filament into a monofilament PMC fabric yarn having an abrasion resistance of between approximately 6,000 and 20,000 cycles (block 20). The monofilament formed in the drawing step (block 20) has, for example, a maximum shrink force temperature of equal to or less than approximately 155° C.

The drawing step (block 20) of the method of the present invention includes the step of processing the monofilament in at least one relaxation oven at a temperature less than approximately 320° F., for example less than approximately 290° F. or less than approximately 250° F. This lower relaxation temperature during processing of the PMC monofilament yarns, which is at least 30° F. less than the state of the art, yields an unexpected result in the form of improved abrasion resistance over PET monofilaments processed according to the known art.

Example

The PET yarn was produced using the conditions listed in table 1. The 0.72 IV PET resin was commercially available.

Table 2 shows the comparison of the physical properties of the PET monofilament yarns produced with a standard process and modified processes. The target diameter of the monofilament was 0.55 millimeter. ASTM D2256-97 method was used to carry out the tensile testing of the yarns. The test utilized to determine abrasion resistance consisted of the squirrel cage method, which includes a rotating drum of metal wires which are positioned perpendicular to the polymer strands. A pretension (load 500 grams for 0.55 millimeter diameter yarn and 350 grams for 0.30 millimeter diameter yarn) is used on each polymer strand prior to starting the drum. One end of the monofilament is fixed and the other end is tied to a weight to normalize the monofilament pretension. For example, a 350 gram weight is used to pretension a 0.30 mm diameter yarn. The typical pretension is around 0.35 g/denier for monofilaments up to 0.50 mm. The monofilament comes in contact with about a quarter of the drum. The test begins by rotating the drum at 60 rpm. The metal wires on the rotating drum continuously abrade the strand and the number of cycles required to break the strand completely is quantified as an abrasion resistance of the yarn.

The maximum shrink force temperature of the monofilament is estimated using a Lenzing TST2 Machine. The yarn was mounted on the tester with one end fixed by a clamp and the other end pre-tensioned (0.01 gram per decitex) before the other end of the yarn was clamped to maintain the pretension prior to the start of the test. The distance between the clamps in this case was 13 inches. The mounted yarn was heated on the tester in a closed environment from 50° C. to 240° C. with a heating rate of 8° C. per minute. The development of the shrink force of the yarn was measured as a function of temperature by the machine. The temperature was then noted where the maximum shrink force value was observed on a shrink force curve. The maximum shrink force temperature of the PET monofilaments according to the present invention is equal to or less than approximately 311° F. (155° C.).

TABLE 1

Monofilament process conditions used to produce the samples listed in Table 2.

| Parameter | Standard PET | Process Modified PET #1 | Process Modified PET #2 | Process Modified PET #3 |
|---|---|---|---|---|
| Extruder Type | Single | Single | Single | Single |
| Extruder Temperature - Zone 1 | 530° F. | 530° F. | 530° F. | 530° F. |
| Extruder Temperature - Zones 2 and 3 | 540° F. | 540° F. | 540° F. | 540° F. |
| Extruder Temperature - Zone 4 | 530° F. | 530° F. | 530° F. | 530° F. |
| Die Temperatures - All Zones | 530° F. | 530° F. | 530° F. | 530° F. |
| Quench Tank Temperature | 140° F. | 140° F. | 140° F. | 140° F. |
| Oven #1 Temperature | 206° F. | 206° F. | 206° F. | 206° F. |
| Relaxation Oven #1 Temperature | 355° F. | 248° F. | 286° F. | 320° F. |
| Relaxation Oven #2 Temperature | 355° F. | 248° F. | 286° F. | 320° F. |
| $1^{st}$ Draw Ratio | 4.35 | 4.35 | 4.35 | 4.35 |
| $2^{nd}$ Draw Ratio | 1.16 | 1.16 | 1.16 | 1.16 |
| $3^{rd}$ Draw Ratio | 0.95 | 0.95 | 0.95 | 0.95 |

TABLE 2

Comparison of yarn properties of standard PET and process modified PET

| | Standard PET 0.55 mm | Process Modified PET 0.55 mm | Process Modified PET 0.55 mm | Process Modified PET 0.55 mm |
|---|---|---|---|---|
| Tenacity (g/den) | 4.08 | 3.85 | 3.93 | 3.95 |
| Shrinkage (176° C./5 min) | 13.3 | 17.6 | 17.6 | 14.6 |
| Elongation (%) | 20.53 | 23.62 | 19.31 | 19.19 |
| Abrasion Resistance - # of cycle to break | 5,000 | 19,000 | 6,800 | 5,200 |
| Max Shrink Force (g) | 491.0 | 616.4 | 302.9 | 513.7 |
| Max Shrink Force temperature (° F.) | 330 | 265 | 300 | 310 |

Example 2

The PET yarn was produced using the conditions listed in Table 3 below. The 0.95 IV PET resin was commercially available.

TABLE 3

Monofilament process conditions used to produce the samples listed in Table 4 below.

| Parameter | Standard PET | Process Modified PET |
|---|---|---|
| Extruder Type | Single | Single |
| Extruder Temperature - Zone 1 | 550° F. | 550° F. |
| Extruder Temperature - Zones 2 and 3 | 565° F. | 565° F. |
| Extruder Temperature - Zone 4 | 565° F. | 565° F. |
| Die Temperatures - All Zones | 565° F. | 565° F. |
| Quench Tank Temperature | 140° F. | 140° F. |
| Oven #1 Temperature | 200° F. | 200° F. |
| Relaxation Oven #1 Temperature | 370° F. | 248° F. |
| Relaxation Oven #2 Temperature | 350° F. | 248° F. |
| $1^{st}$ Draw Ratio | 4.10 | 4.10 |
| $2^{nd}$ Draw Ratio | 1.30 | 1.30 |
| $3^{rd}$ Draw Ratio | 0.94 | 0.94 |

TABLE 4

Comparison of yarn properties of standard PET and process modified PET

| | Standard PET 0.30 mm | Process Modified PET 0.30 mm |
|---|---|---|
| Tenacity (g/den) | 5.34 | 4.87 |
| Shrinkage (176° C./5 min) | 15.10 | 21.10 |
| Elongation (%) | 17.01 | 19.18 |
| Abrasion Resistance - # of cycle to break | 5,700 | 18,000 |

Table 4 shows the comparison of the physical properties of the PET monofilament yarns produced with the standard process and with the inventive modified process. The target diameter of the monofilament was 0.30 millimeter. Tensile properties and abrasion resistance of the samples were measured by the same test methods as those described above with respect to Example 1.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine clothing (PMC) fabric yarn for use in a PMC fabric, said PMC fabric yarn having a composition consisting of one of polyethylene terephthalate (PET) and PET combined with at least one additive, said PET fabric yarn having an abrasion resistance of greater than 6,000 cycles and a maximum shrink force temperature equal to or less than 310° F.

2. The PMC fabric yarn according to claim 1, the yarn having a diameter between approximately 0.05 and 1.00 millimeters (mm).

3. The PMC fabric yarn according to claim 2, wherein the yarn has a diameter between 0.10 and 0.70 mm.

4. The PMC fabric yarn according to claim 1, wherein said PMC fabric yarn is processed in at least one relaxation oven at a temperature less than approximately 320° F.

5. The PMC fabric yarn according to claim 4, wherein said temperature is less than approximately 290° F.

6. The PMC fabric yarn according to claim 5, wherein said temperature is less than approximately 250° F.

7. The PMC fabric yarn according to claim 1, said PET fabric yarn having a diameter of up to 0.50 millimeters (mm) and said abrasion resistance of said PET fabric yarn measured according to a squirrel cage method, said PET fabric yarn having a pretension of approximately 0.35 grams per denier.

8. A paper machine clothing (PMC) fabric including a plurality of monofilament yarns, at least some of said monofilament yarns having a composition consisting of one of polyethylene terephthalate (PET) and PET combined with at least one additive, said PET monofilament yarns having an abrasion resistance of greater than 6,000 cycles and a maximum shrink force temperature equal to or less than 310° F.

9. The PMC fabric according to claim 8, wherein said PET monofilament yarns have a diameter between approximately 0.05 and 1.00 millimeters (mm).

10. The PMC fabric according to claim 9, wherein said diameter between 0.10 and 0.70 mm.

11. The PMC fabric according to claim 8, wherein the PMC fabric is one of a woven fabric and a spiral fabric.

12. The PMC fabric according to claim 8, wherein said PET monofilament yarns are processed in at least one relaxation oven at a temperature less than approximately 320° F.

13. The PMC fabric according to claim 12, wherein said temperature is less than approximately 290° F.

14. The PMC fabric according to claim 13, wherein said temperature is less than approximately 250° F.

15. The PMC fabric according to claim 8, said PET monofilament yarns having a diameter of up to 0.50 millimeters (mm) and said abrasion resistance of said PET monofilament yarns measured according to a squirrel cage method, each of said PET monofilament yarns having a pretension of approximately 0.35 grams per denier.

* * * * *